US011270678B2

(12) United States Patent
Jarvis

(10) Patent No.: US 11,270,678 B2
(45) Date of Patent: Mar. 8, 2022

(54) GUITAR POSITIONING DEVICE

(71) Applicant: Terry Scott Jarvis, Whiteville, TN (US)

(72) Inventor: Terry Scott Jarvis, Whiteville, TN (US)

( * ) Notice: Subject to any disclaimer, the term of this patent is extended or adjusted under 35 U.S.C. 154(b) by 0 days.

(21) Appl. No.: 16/974,408

(22) Filed: Jan. 19, 2021

(65) Prior Publication Data

US 2021/0375243 A1 Dec. 2, 2021

Related U.S. Application Data

(60) Provisional application No. 63/101,943, filed on May 26, 2020.

(51) Int. Cl.
*G10D 3/18* (2020.01)
*G10G 5/00* (2006.01)

(52) U.S. Cl.
CPC ..... *G10G 5/005* (2013.01); *G10D 3/18* (2013.01)

(58) Field of Classification Search
CPC ..... G10G 5/005; G10D 3/18; G10D 3/00
See application file for complete search history.

(56) References Cited

U.S. PATENT DOCUMENTS 7,205,468 B1 * 4/2007 Johnson ..... G10G 5/005 84/327
2007/0193431 A1 * 8/2007 Sweeney ..... G10G 5/005 84/327

* cited by examiner

*Primary Examiner* — Kimberly R Lockett
(74) *Attorney, Agent, or Firm* — Paul M. Denk

(57) ABSTRACT

A guitar positioning device, including a strip of resilient or flexible material, such as formed or molded from rubber, or polymer, can be adhered to the lower or lateral edges of the guitar, or banjo, in which it is used, while the exposed surface of the device will frictionally engage upon the legs of the musician, so as to prevent slippage of the instrument during its usage and application. The positioning device can be adhered by integral suction cups, at least two in number, or by an adhesive, a double sided tape, or even hook and pile fastening means, or rivet, in order to secure the positioning device to the exposed edge of the instrument that rests upon the legs of the musician, during a performance.

4 Claims, 1 Drawing Sheet

GUITAR POSITIONING DEVICE

CROSS-REFERENCE TO RELATED APPLICATION

This application is a non-provisional of the provisional application filed on May 26, 2020, under Ser. No. 63/101,943.

FIELD OF THE INVENTION

This invention relates to the application and usage of a device that may be connected or otherwise adhered to that edge of a guitar, particularly an electric guitar, that rests upon the regular legs of the performer, in order to retain the guitar into a fixed position, particularly during the strenuous playing of the guitar during a performance, and to keep it from slipping from leg support during such applications.

BACKGROUND OF THE INVENTION

As is generally known in the art, particularly when performing upon an electric type of guitar, or even a standard guitar in certain instances, and while the performer is seated, it is quite common to rest the lower edge of the guitar upon the leg(s) of the player to obtain support, while performing. Usually, particularly with an electric guitar, which may be or have thinner structure for the guitar housing, even though it may embody some of the electronics therein, it is difficult to keep the guitar from sliding around on the legs, particularly when undertaking a very active and strenuous performance, which is normally encountered this day and age when performing the more contemporary type of music. Usually, current songs, particularly those that have a guitar background, can reach a crescendo point, where the guitar player plays a major role in the generated music, and it can be quite a strenuous undertaking, which as previously explained, can lead towards movement of the guitar upon the legs of the performer, during the performance of such music.

Frequently, when the guitar player is practicing at home, and specifically when a performer is a beginner guitar player, or even an advanced performer, the guitar will frequently slide around upon the legs of the user, and frequently, such a performer will have to prop his/her legs up on a footstool or use some type of a pad underneath of the guitar, so as to control the stability of the guitar, when resting upon the legs, during such performance.

Frequently when the guitar player is sitting down, and undertaking a performance, the guitar will swing back and forth during the performance, but usage of the current invention is designed to prevent that type of a predicament.

Thus, the nature of the problem encountered by a guitar player, the type of problems that are associated therewith, and the means remedying that concern, is what is the subject matter of the improvement of the current invention.

SUMMARY OF THE INVENTION

This invention contemplates means for holding a guitar in place usually upon the legs of performer, especially when in a seated position, so as to allow the performer to concentrate and focus upon the playing of the music, maintaining the proper cords, without having to worry about the guitar sliding off of his/her legs, while practicing, or performing in a musical session.

The subject matter of this invention includes a device that is applied to the side of the guitar, or even a banjo, may have some frictional attributes, such that when that side of that guitar is resting upon the legs of the performer, it will not slide off, and remain intact, to allow the performer to play the string instrument to their fullest talent.

The device includes a length of frictional material, whether it be rubber, polymer, like flexible urethane, or any other type of resilient material, which may be bent or shaped into the configuration of the contiguous side of the guitar, and then be held in place by any form of fastening means, whether it be suction cups, that may be integrally formed upon the inner surface of the device, or be held by rivets in place, or even by a double sided tape, or perhaps even a length of Velcro, that will fasten the flexible device directly to the side edge of the guitar, during its usage. Usually, this device will have a length anywhere between 4" to 12", 6" being the preferable amount, it is shaped to fit into the contours of the adjacent guitar, to which it is contiguously affixed, such that when the guitar is resting upon the legs of the user, it will remain in place, and not slip freely, which can be disastrous to the performer of such an instrument, particularly when performing in a high intensity setting, to fast playing music, as is normally encountered by a guitar player, banjo player, or the like.

The concept of this invention is to have a length of such a resilient member, and in the preferred embodiment, upon its under surface, particularly when molded from rubber or polymer, will have integrally formed at least a pair of suction cups, that can be applied directly to the smooth adjacent side surfaces of such instruments, when prepared for usage. Hence, by the use of suction cups, double sided tape, or even Velcro, the device can be removed, if preferred, by the performer, during non-usage. On the other hand, the device may be secured more permanently to a guitar or banjo, as through the use of a series of rivets, or screws, without detracting from the generation of sounds, from the guitar proper, during its usage and application.

It is likely that such a device, of this invention, may be molded of a more resilient type of plastic, such as urethane, or even rubber, and that such resilient material will have frictional characteristics, upon their exposed surfaces, such that it can be simply engaged upon the edges of the guitar, and rest upon the legs of the user, and have its lower bottom surface either of an inherent friction, or be molded having a more abrasive type of surface, whether it be a series of downwardly depending protrusions, ribs, pebble grained, and the like, in order to engage the legs of the user, or have inherent friction in the molded or coated device, to maintain its adhesion to the leg surface during usage.

It is, therefore, the principal object of this invention to provide a guitar positioning device, that can be secured to the lower or side edges of the guitar, that rest upon the anatomy of the performer, and prevent the guitar from sliding therefrom, during the conduct of a performance.

Another object of this invention is to provide an integral structure, that may be coated with a frictional material, such as a rubber or polymer, or perhaps even be formed from a rubber or polymer, having inherent friction, and then be applied by a double sided adhesive tape, or other attachment device, such as Velcro, to adhere to the contiguous surfaces of the guitar, with the exposed surface of the device frictionally engaging upon the legs of the user, during the conduct of a session utilizing such a guitar.

Another object of this invention is to provide a guitar positioning device that may permanently secure to the exposed side or lower edges of the guitar, at those surfaces that rest upon the legs of the user.

Another object of this invention is to provide a device for holding an electric guitar position during conduct of a strenuous performance of music.

Yet another object of this invention is to provide means for adhering a guitar to its user, so as to prevent it slipping during a conduct of a musical performance.

These and other objects may become more apparent to those skilled in the art upon review of the Summary of the Invention as provided herein, and upon undertaking a study of the Description of its Preferred Embodiment, in view of the drawings.

DESCRIPTION OF THE PREFERRED EMBODIMENT

Figure 1:
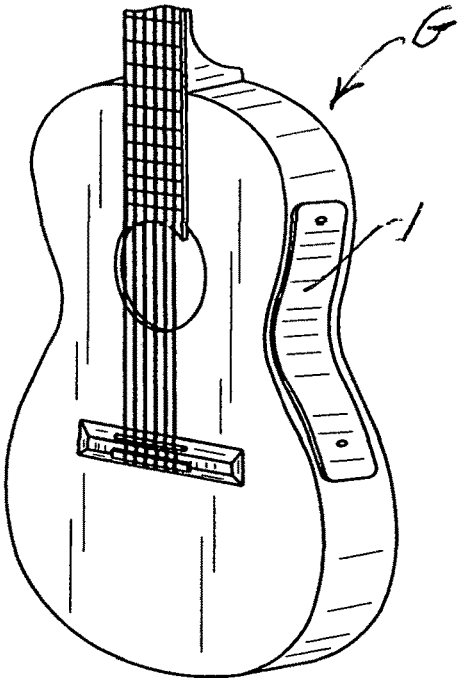
FIG. 1 is as isometric view of a part of a guitar showing the guitar positioning device of this invention applied to the lateral edge surfaces of the guitar, particularly when resting upon the legs of the performer.
Figure 2:
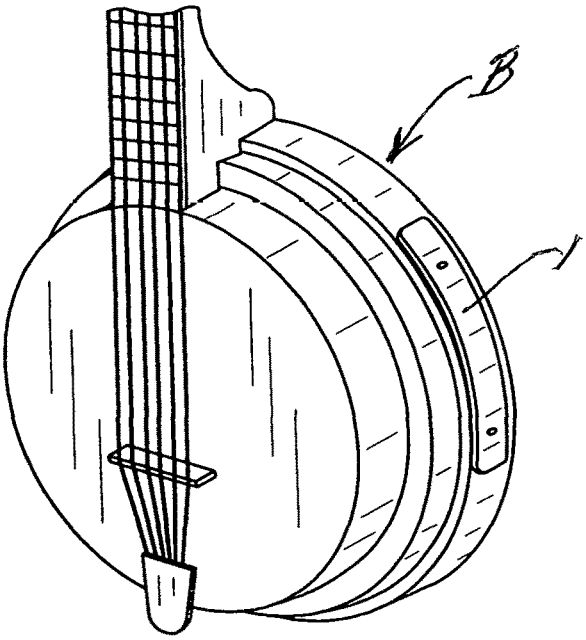
FIG. 2 is a partial view of a banjo, showing a similar type of device applied to the lateral surface of the instrument, to keep it from sliding from the performer's legs, during usage.

In referring to the drawings, and in particular FIGS. 1 and 2, the guitar positioning device 1 of this invention is shown in usage, and as therein disclosed, and as can be seen, the device is applied to the lateral edges of the guitar G, or the banjo B, as can be readily seen. Since the device 1 is applied to the lower edge or lateral edge of the musical instrument, that is embraced by the device, as it rests upon the legs of the user, the device is designed to secure, by friction, upon the leg of the musician, so as to prevent the instrument from sliding off of the user, particularly when performing a strenuous piece of music.

Figure 3:
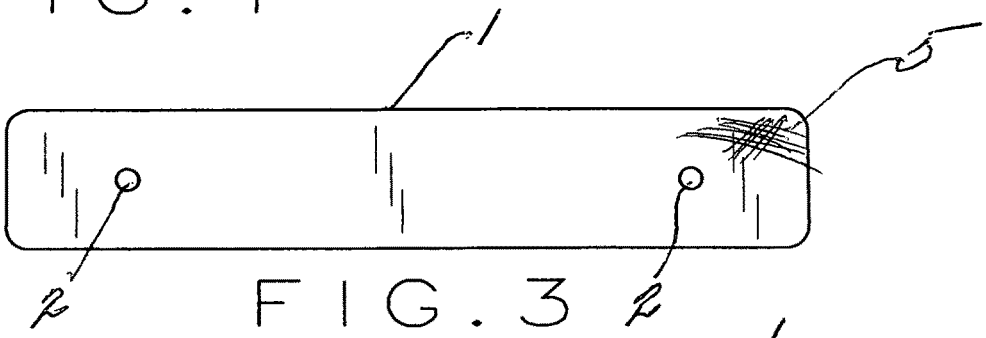
FIG. 3 shows a strip of the guitar positioning device, which may be formed of a rubber or polymer, having length, and which may be secured, such as by rivets or screws, permanently to the side of the musical instruments as shown in FIGS. 1 and 2.

FIG. 3 shows the guitar positioning device 1 and how it may comprise a strip of resilient material, whether it be molded from rubber, from a polymer, such as urethane, and be of a length of approximately 6", having a width of approximately 1" or 2", and then secured by means of rivets, as at 2, for more permanent fixation of the positioning device to the musical instrument, sustaining prolonged usage.

Figure 4:
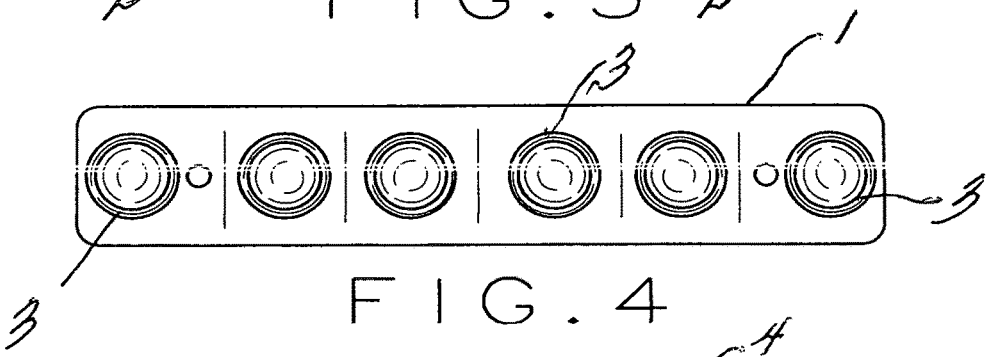
FIG. 4 provides a bottom side view of a guitar positioning device, that may be formed of rubber or polymer, and having integrally formed suction cups that secure the strip of the device to the lateral edge of the guitar or banjo, as noted in FIGS. 1 and 2.
Figure 5:
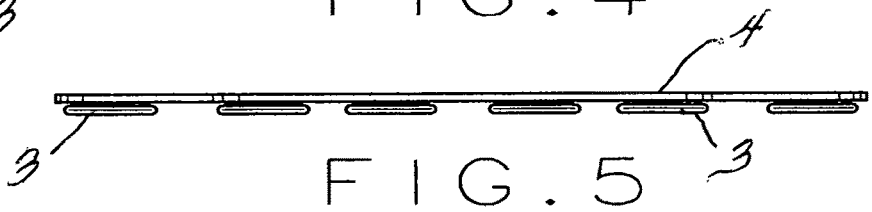
FIG. 5 is a front edge view of the guitar positioning device of FIG. 4, further showing its integrally formed suction cups that are used for application and installation of the device to the identified musical instruments.

Or, as noted in FIG. 4, the strip of material 1 forming the guitar positioning device may have molded upon its undersurface, a series of at least a pair of suction cups, as at 3, so that through these integral cups the positioning device can be applied to the lateral edges of the guitar, or banjo, as noted in FIGS. 1 and 2. The integral application of the suction cups 3 to the undersurface of the strip of material forming the guitar positioning device 1, can be more clearly seen in FIG. 5.

It is just as likely that these fastening means, whether it be rivets 2, screws, suction cups 3, or any other types of fastening means, could also include the usage of a more temporary type of double sided adhesive tape, that is applied to the under surface of the strip material, when it is applied to the lateral edges of the musical instruments, as noted. Or, a hook and pile fastening means, can be used, identified by the trademark Velco, for application of such a strip of material to the sides of the musical instruments, which means that the positioning device can be removed, after usage, at the desire of the performer.

The strip of material can also be formed of other materials, even metal, having resiliency, and having a rubberized coating, polymer coating, or the like, applied to the strip, obtained by dipping of the device into a batch of such materials, in order to attain adherence of the coatings to the surface of the strip of device, in preparation for its application and usage. Or, as stated, in the preferred alternative, the device may be molded from a polymer, or rubber, and even have its suction cups integrally formed and molded therewith, in preparation for immediate usage after its formation. With these types of fastening means, the device, of these types, can be applied directly to the lateral edges of the instrument, and when used by the musician, the guitar or banjo will be frictionally held into place, and prevented from slipping off of the user's legs, during a routine or strenuous performance.

In addition, where the device may be formed of a polymer, or rubber, as explained previously, its outer exposed surface, such as that as noted at 4, may be formed containing miniscule projections, or ribs, or pebble grained, as at 5, so as to add to the frictional engagement of the device initially to hold the guitar in position, upon the legs of the user, as previously explained.

In any event, the primary object of the invention is to provide a device that can be engaged to the edge of the guitar and held thereto by any type of fastening means, such as frictional engagement, or by other adhering means, even an adhesive, and at the same time, have a surface that does frictionally engage upon the legs of the user, so as to prevent slippage of the musical instrument, during its performance.

Variations or modifications of the subject matter of this invention may occur to those skilled in the art upon review of the disclosure as provided herein. Any such variations, if within the spirit of this invention, are intended to be encompassed within the scope of any claims to patent protection issuing herein. The description of the invention in the Specification, and its depiction in the drawings, are set forth for illustrative purposes only.

I claim:

1. A guitar positioning device, including a strip of resilient or flexible rubber or polymer material, having a length of approximately 4" to 8", and a width of less than 3", said positioning device capable of being applied to the side edge of a guitar or banjo, and said positioning device having a first surface and an opposite second surface, said positioning device provides a frictional material on said first surface that can adhere to and obtain support for the guitar upon a leg of a musician utilizing the guitar during a performance, and said strip of material forming said positioning device having on an opposite surface a fastening member for application directly to the side edge of the guitar and for use for holding said guitar through said positioning device onto the leg of a musician utilizing the guitar during a performance;

said fastening member having at least two suction cups provided integrally upon the opposite side of the positioning device from the first surface and its frictional surface, and for use for securing said strip of the positioning device directly to a side edge of the musical instrument, wherein said at least two suction cups are integrally formed upon that opposite surface of the strip of resilient material to provide for securement of the positioning device directly to the side edge of a musical instrument and thereby exposing the frictional material to a leg of a musician during a performance.

2. The guitar positioning device of claim 1, wherein the strip of frictional material may be one of rubberized material and polymer material.

3. The guitar positioning device of claim 1, wherein the frictional material may be a plurality of protrusions or projections extending from the surface of the strip of frictional material to provide said friction when applied to the musical instrument, as when resting upon a leg(s) of the musician during a performance.

4. The guitar positioning device of claim 1, wherein said strip of frictional material has a coating applied thereon, and such coating being one of a rubberized material or a polymer, which when the positioning device is applied by a fastening member, to the edge of the musical instrument, it adheres it in place, while the device is rested upon a leg of the musician, during performance, and prevents slippage of the instrument from that location.

* * * * *